US007000676B2

(12) United States Patent
Chu et al.

(10) Patent No.: US 7,000,676 B2
(45) Date of Patent: Feb. 21, 2006

(54) CONTROLLED FLUID FLOW MOLD AND MOLTEN METAL CASTING METHOD FOR IMPROVED SURFACE

(75) Inventors: Men G. Chu, Export, PA (US); Alvaro Giron, Murrysville, PA (US); William A. Casada, Cheswick, PA (US); Ho Yu, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/880,200

(22) Filed: Jun. 29, 2004

(65) Prior Publication Data

US 2005/0284603 A1 Dec. 29, 2005

(51) Int. Cl.
*B22D 11/049* (2006.01)

(52) U.S. Cl. ..... 164/487; 164/444

(58) Field of Classification Search ..... 164/487, 164/444, 418, 467

See application file for complete search history.

(56) References Cited

U.S. PATENT DOCUMENTS

| | | | | |
|---|---|---|---|---|
| 3,111,732 A | | 11/1963 | Schroer et al. | |
| 3,672,431 A | * | 6/1972 | Bryson | 164/489 |
| 4,694,880 A | * | 9/1987 | Gladwin | 164/459 |
| 4,766,948 A | | 8/1988 | Behr et al. | 164/516 |
| 5,207,974 A | | 5/1993 | Yun | 266/230 |
| 5,255,731 A | | 10/1993 | Yun | 164/135 |
| 5,325,910 A | | 7/1994 | Schneider et al. | 164/472 |
| 5,620,671 A | | 4/1997 | Shoemaker | 422/261 |
| 6,152,052 A | | 11/2000 | Saxon et al. | 110/262 |
| 6,340,048 B1 | * | 1/2002 | Tsune et al. | 164/418 |
| 6,354,363 B1 | | 3/2002 | Perrin et al. | 164/444 |
| 6,419,004 B1 | | 7/2002 | Jolivet et al. | 164/418 |
| 6,474,401 B1 | * | 11/2002 | Streubel | 164/418 |
| 6,491,087 B1 | | 12/2002 | Tilak | 164/444 |

* cited by examiner

*Primary Examiner*—Kuang Y. Lin
(74) *Attorney, Agent, or Firm*—Norman F. Hainer; Eckert Seamans Cherin & Mellott, LLC

(57) ABSTRACT

A DC casting mold for casting molten metal alloy comprising a cooled tubular body that has a thermally insulated insert attached to its top surface. The thermally insulated insert has a bottom portion with a beveled sidewall, which forms an angle with the horizontal melt surface layer of the molten metal and creates an eddy. The eddy causes a substantial number of oxides that are formed during the casting process to remain in the bottom sidewall portion of the thermally insulated insert of the mold, thereby substantially reducing the number of ingot surface imperfections that promote ingot cracking. In addition, the eddy promotes break-up of the oxides into smaller pieces as the oxides flow toward the cooled inner walls of the cooled tubular body, thereby having limited surface area for growth of oxide folds. A method of casting molten metal alloys with improved surface quality is also disclosed.

20 Claims, 3 Drawing Sheets

CONTROLLED FLUID FLOW MOLD AND MOLTEN METAL CASTING METHOD FOR IMPROVED SURFACE

FIELD OF THE INVENTION

The invention relates to the field of continuously or semi-continuously casting and solidifying molten metal and metal alloys using a mold. More particularly, the invention relates to direct chill ("DC") casting of an ingot, utilizing an improved mold design and casting method to significantly reduce the number of oxides present on the surface of the ingot therefore reducing surface imperfections that may create cracks in the ingot.

BACKGROUND OF THE INVENTION

It is well known in the aluminum alloy casting art that molten metal ("melt" for brevity) surface oxidation can result in various surface imperfections in cast ingots such as pits, vertical folds, oxide patches and the like, which may develop into cracks during casting or in later processing. A crack in an ingot or slab that propagates during subsequent rolling, for example, can lead to expensive remedial rework or scrapping of the cracked material.

The casting of alloys may be done by any number of methods known to those skilled in the art, such as for example, semi-continuous casting (direct chill casting (DC), electromagnetic casting (EMC), horizontal direct chill casting (HDC)), hot top casting, continuous casting, die casting, roll casting, and sand casting.

Continuous casting refers to the uninterrupted formation of a cast body or ingot. For example, the body or ingot may be cast on or between belts, as in belt casting. Casting may continue indefinitely if the cast body is subsequently cut into desired lengths. Alternately, the pouring operation may be started and stopped when an ingot of desired length is obtained. The latter situation is referred to as semi-continuous casting.

Each of the casting methods mentioned above has a set of its own inherent problems, but with each technique, surface imperfections can still be an issue. One mechanical means of removing surface imperfections from an aluminum alloy ingot is scalping. Scalping is the machining off of the surface layer along the sides of an ingot after it has solidified. Scalping is undesirable because of the inherent waste of energy and time and the generation of scrap alloy.

It is known in the art that the quality of a cast aluminum alloy ingot is related to the distribution of the melt, and the rate of melt flow into the mold. Melt distributor and melt filtration devices are described in the prior art, and include a "sock" of flexible glass cloth, disclosed in U.S. Pat. No. 3,111,732; a glass fiber bag marketed under the name "COMBO® bag" by Kabert Industries, Inc., Villa Park, Ill.; the "MINI® bag" also marketed by Kabert Industries, Inc.; and a "bag-in-a-bag" as disclosed in U.S. Pat. Nos. 5,207,974 and 5,255,731.

During ingot casting, turbulence, air-formed oxide, and surface waves in the melt generate oxides, which adversely affect the economics of ingot production. Surging, as a result of waves in the melt, entraps air in the melt and results in oxide formation. Some of the oxides are trapped by the solidifying butt shell and may act as initiation sites for butt cracks. The remaining oxides float out to the surface of the melt and accumulate in the mold cavity. The accumulated oxides grow in thickness and area until they are entrapped on the surface or in the subsurface of the molten ingot as casting proceeds. Patches of entrapped oxides, especially those at the surface, may cause surface imperfections that may lead to ingot cracks that require scalping.

Certain magnesium containing aluminum alloys, such as 7050 and other 7xxx alloys as well as 5xxx alloys such as 5182 and 5083, are especially prone to surface defects and cracking. It is known to add beryllium or other additives to the melt to control melt surface oxidation and to prevent magnesium loss due to oxidation. However, the use of beryllium or other additives can be very costly. For this reason, although beryllium and other additives are effective at controlling melt surface oxidation and surface defects in aluminum cast ingots, a suitable alternative approach is needed.

There remains a need for an effective alternative to the use of beryllium or other additives to substantially reduce the number of oxides present at the ingot surface so as to minimize the number of surface imperfections, such as vertical folds, pits, oxide patches and the like from forming during aluminum ingot casting. Such a method would be instrumental in substantially reducing the number of cracks that may form during casting or in later processing. Finally, the method preferably would have little or no adverse affect on alloy properties.

The primary object of the present invention is to provide a direct chill mold design for the casting of aluminum alloys that controls the flow of the melt so as to minimize the amount of oxides present at the surface of the ingot and therefore substantially reduce the occurrence of ingot surface imperfections, such as vertical folds, pits, and oxide patches.

Another object of the instant invention is to provide a direct chill mold design for the casting of aluminum alloys that reduces the occurrence of ingot cracking due to surface imperfections that are formed by oxides that are present at the ingot surface.

Another object of the instant invention is to provide a semi-continuous direct chill mold design for the casting of aluminum alloys that incorporates a continuous lubrication system.

A further object of this invention is to provide a method for casting aluminum alloys with improved surface quality without the need for adding beryllium or other additives to the alloy.

These and other objects and advantages are met or exceeded by the instant invention, and will become more fully understood and appreciated with reference to the following description.

SUMMARY OF THE INVENTION

The instant invention relates to the design of a direct chill (DC) casting mold to control the flow of the melt in the mold so that the number of oxides that form on the surface of the melt and become entrained on or near the surface of the solidifying ingot are reduced. By substantially reducing the number of oxides on the surface of the melt from flowing down and becoming entrained on or near the surface of the solidified ingot, imperfections on the ingot surface, such as vertical folds, oxide patches, and pits are minimized. Minimizing surface imperfections on the ingot results in less ingot cracking and reduces costly remedial rework or scrapping of ingots.

The design of the DC casting mold of this invention comprises a cooled tubular body that has a top surface having an orifice, a bottom surface having an orifice, and cooled inner walls. The molten metal solidifies when it contacts the cooled inner wall. An annular ring is attached to the top surface of the cooled tubular body and has a lip that overlaps the cooled inner wall of the cooled tubular body. In addition, attached to the annular ring and cooled inner wall is a bottom portion of a thermally insulated insert. The bottom portion has a beveled sidewall that overlaps the cooled inner wall and is angled inwardly toward the center of the mold cavity. The thermally insulated insert also has a top portion that is wider than the bottom portion. The beveled sidewall forms an angle with the horizontal melt surface layer of the molten metal to create an eddy during pouring of the melt.

The eddy creates a recirculation zone that causes direction of the casting flow to be opposite the main casting flow on the horizontal melt surface thereby causing a substantial number of oxides formed during the casting process to remain in the bottom sidewall portion of the thermally insulated insert. In addition, the eddy promotes break-up of the remaining oxides into smaller pieces as these oxides flow toward the cooled inner walls of the cooled tubular body thereby having limited surface area for growth of oxide folds that promote surface imperfections. A means to distribute the melt is positioned underneath a spout that delivers molten metal from a container and into the mold cavity. The distribution means distributes the melt over a designated area within the mold cavity.

For the purposes of the instant invention, it is preferred that the distribution means diffuses the initial downward velocity of the melt emerging from the spout, so that the emerging melt does not cause significant turbulence, surging, and surface waves in the melt. Turbulence, surging, and surface waves in the melt entrap air and generate a high level of oxides in the melt, and result in ingot surface imperfections, such as oxide patches, that may promote ingot cracking.

DETAILED DESCRIPTION OF PREFERRED EMBODIMENT

The instant invention provides a mold design and ingot casting method for minimizing the number of oxides at the surface of the ingot thereby substantially reducing ingot surface imperfections, which in turn reduces the occurrence of ingot cracking, and thus improves recovery. While not desiring to be bound by any particular theory, it is believed that the inventive mold design and ingot casting method produces a whorl near the beveled sidewalls of the thermally insulated insert. The whorl creates a retransmission zone that causes direction of the casting flow to be opposite the main casting flow on the horizontal melt surface layer, thereby causing a substantial number of oxides that are formed during the casting process to remain in the bottom thermally insulated sidewall portion of the mold. This in turn substantially reduces the number of ingot surface imperfections that promote ingot cracking. In addition, the whorl promotes break-up of the remaining oxides into smaller pieces as these oxides flow toward the cooled inner wall of the cooled tubular body thereby providing limited surface area for nucleation and growth of oxide folds in the cooling ingot that can lead to ingot surface imperfections.

For convenience, the present invention is described as having one liquid inlet channel and lubricant feed line, one liquid and lubricant reservoir, and one liquid outlet channel. However, the invention includes two liquid inlet channels and lubricant feed lines, two liquid reservoirs and outlet channels, and two lubricant reservoirs. The feed lines, reservoirs, and channels are located within the mold and on opposite sides of it.

Figure 1:
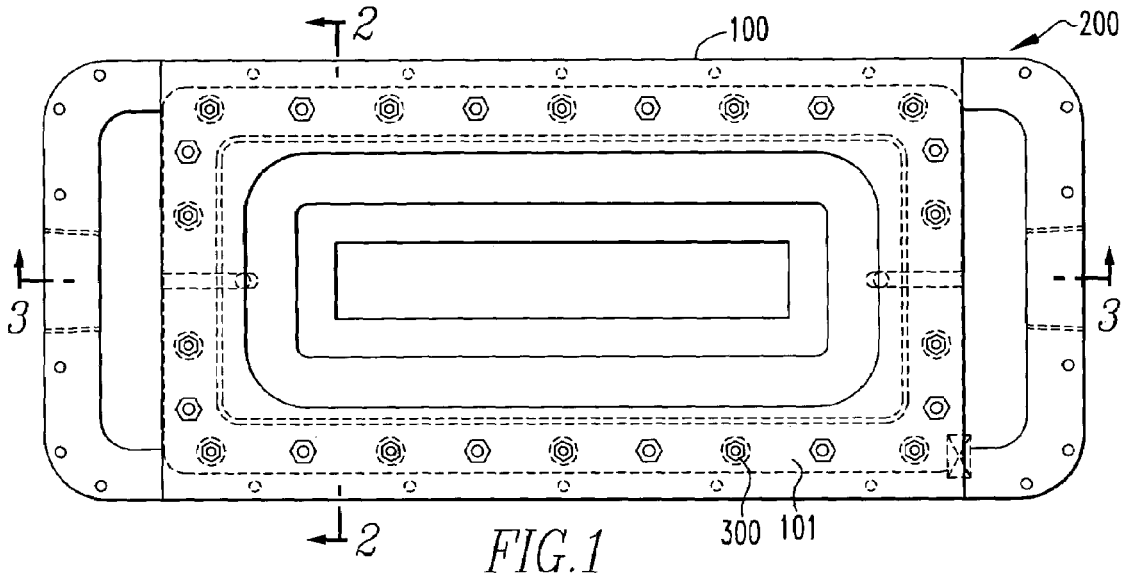
FIG. 1 is a top view of the cooled tubular body of the controlled fluid mold of this invention

FIG. 1 is a top view of the cooled tubular body 100 of the controlled fluid flow mold 200 of this invention. Pluralities of lubricant channels 300 are located around the perimeter of the top surface 101 of the cooled tubular body 100. Lubricant is directed into the channels 300 by two pumps (not shown) that are connected to the sides of the cooled tubular body 100.

Figure 2:
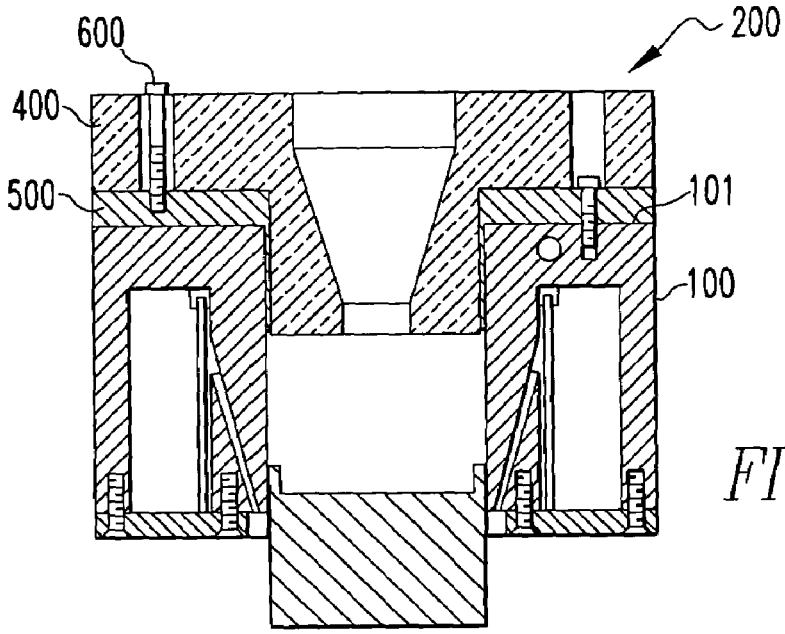
FIG. 2 is a cross section through 2—2 of the controlled fluid mold of FIG. 1 of this invention.
Figure 4A:
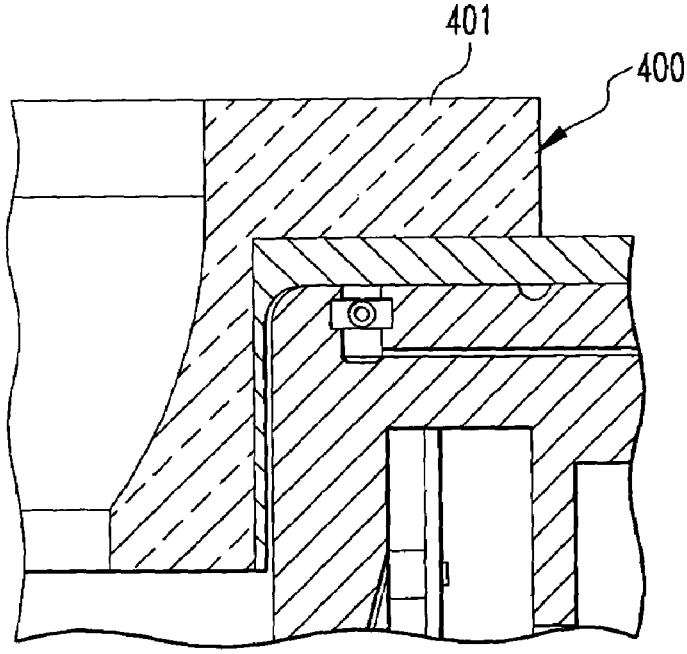
FIGS. 4*a*–4*d* are partial cross-sectional views of alternative surfaces for the bottom sidewall portion of the thermally insulated insert.
Figure 4B:
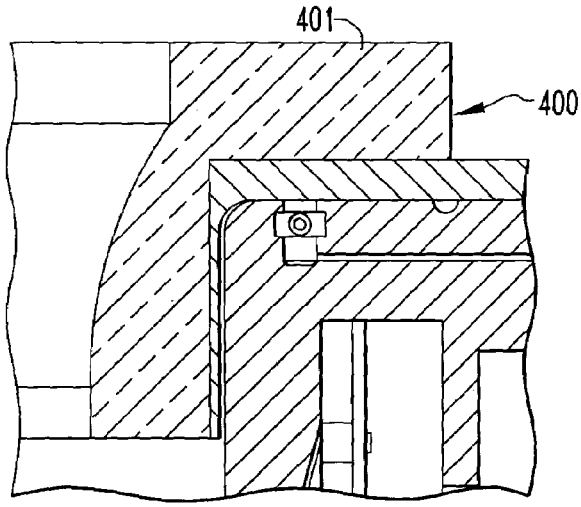
Figure 4C:
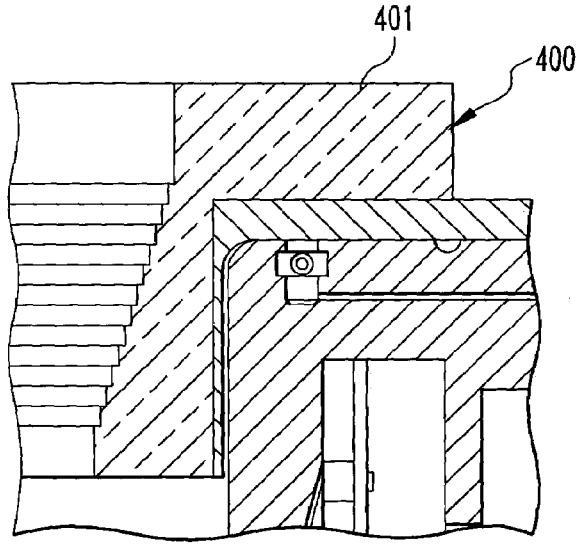
Figure 4D:
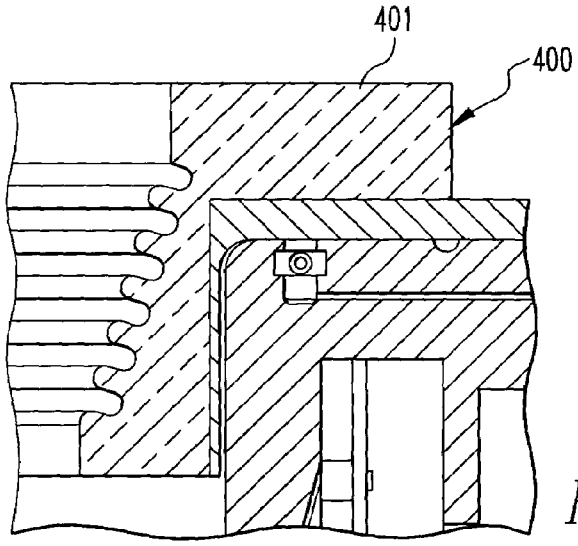

Referring now to FIG. 2, a cross section through 2—2 of the controlled fluid flow mold 200 of FIG. 1 of this invention is shown. The thermally insulated insert 400 and annular ring 500 are attached to the top surface 101 of the cooled tubular body 100. Attachment means such as clamps 600 can be inserted through the thermally insulated insert 400 and the annular ring 500 and into the cooled tubular body 100. The clamps 600 preferably are aluminum or steel material, however the clamps 600 may be comprised of any metal or metal alloy that does not soften at aluminum alloy melt casting temperatures.

Figure 3:
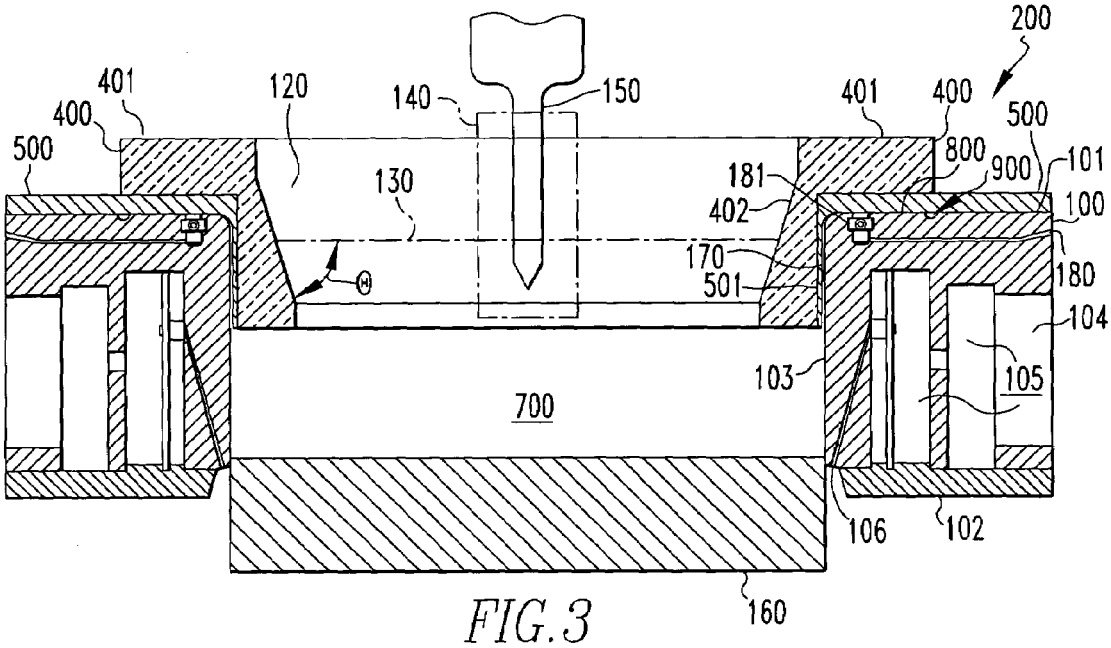
FIG. 3 is a cross section through 3—3 of the controlled fluid mold of FIG. 1 of this invention.

Referring now to FIG. 3, a cross section through 3—3 of the controlled fluid flow mold 200 of FIG. 1 of this invention is shown. The controlled fluid flow mold 200 comprises a cooled tubular body 100, which holds molten metal during casting. For the casting of aluminum and aluminum alloys, the cooled tubular body 100 is copper metal or a copper alloy, however the cooled tubular body 100 may be comprised of any metal, metal alloy, or nonmetal that does not soften at aluminum alloy melt casting temperatures. In a preferred embodiment for casting aluminum alloy ingots, the cooled tubular body 100 is shaped as a hollow body having a central cavity 700 that is open on each end. The cooled tubular body 100 has a top surface having an orifice 101, a bottom surface having an orifice 102, and a cooled inner wall 103. The cooled tubular body 100 contains a means for cooling, comprising a liquid inlet channel 104, liquid reservoir 105, and a liquid outlet channel 106. The liquid flows from a liquid pump (not shown) that is connected to the sides of the cooled tubular body 100, through the liquid inlet channel 104, through the liquid reservoir 105, into the liquid outlet channel 106, and out onto the ingot surface. The liquid in the reservoir 105 serves to both cool the cooled tubular body 100 and cool the casting by spraying along the cooling ingot surfaces from channel 106. The liquid is preferably water, but could be of any liquid suitable for the purpose of cooling the ingot.

An annular ring 500 is positioned on the top surface 101 of the cooled tubular body 100 and has a lip 501 overlapping the cooled inner wall 103 of the cooled tubular body 100. The annular ring 500 can be made of metal or any material that does not melt at casting temperatures. Preferably, the ring 500 is made of aluminum or steel alloys. In addition to preventing the lubricant from being absorbed into the thermally insulated insert 400, the annular ring 500 assists in directing a continuous lubricant flow across the top surface 101 and down the cooled inner wall 103 of the cooled tubular body 100. Sealing means 900 is used to seal the gap 800 between the top surface 101 of the cooled tubular body 100 and the annular ring 500. Sealing the gap 800 causes the lubricant flow to be continuous. The sealing means 900 is comprised of any type of polymer material, such as rubber, silicone, or plastic.

As shown in FIGS. 1 and 3, the cooled tubular body 100 contains a means for continuous lubrication comprising a lubricant feed line 180, a reservoir 181, and lubricant channels 300. The lubricant, which is directed into the channels 300 by two pumps (not shown) that are connected to the sides of the cooled tubular body 100, flows through the lubricant feed line 180, into the reservoir 181, and out through the channels 300. From the channels 300, the lubricant flows between the top surface 101 of the cooled tubular body 100 and the annular ring 500 down between the cooled inner wall 103 of the cooled tubular body 100 and the lip 501 of the annular ring 500. The lubricant continues to flow toward an area of transition of the bottom sidewall portion 402 of the thermally insulated insert 400, the lip 501 of the annular ring 500, and the cooled inner wall 103 of the cooled tubular body 100. Thereafter, the lubricant flows through a gap 170 between said cooled inner wall surface 103 and said molten metal to be cast. Finally, the lubricant is washed off of the solidified ingot by cooling liquid that sprays from the liquid outlet channel 106. The lubricant functions to keep molten metal from adhering to the cooled inner wall 103. The lubricant is comprised of any lubricant that is suitable for use in a casting apparatus, such as caster oil, rapeseed oil, or vegetable oil.

A thermally insulating insert 400 is positioned above the cooled tubular body 100 and the annular ring 500. The insert 400 is made of a material that, in addition to preventing absorption of the molten metal, insulates the molten metal from the cooled inner wall 103 and does not chemically react with the metal. In a preferred embodiment, the thermally insulating insert 400 is comprised of a ceramic material. In a more preferred embodiment, the thermally insulating insert 400 comprises a calcium silicate reinforced with graphite fiber.

The thermally insulating insert 400 further comprises a top portion 401 and a bottom portion 402 with a beveled sidewall that overlaps the annular ring 500 and the cooled inner wall 103 of the cooled tubular body 100. The top portion 401 is wider than the bottom portion 402 and an angle θ 120 is formed between the beveled sidewalls of the bottom portion 402 and the horizontal melt surface layer 130. In a preferred embodiment, the angle θ 120 is from about 1° to about 89°. In a more preferred embodiment, the angle θ 120 is from about 20' to about 70°. In even a more preferred embodiment, the angle θ 120 is from about 40° to about 50°. The angle 120 creates an eddy. The eddy creates a recirculation zone that causes direction of the casting flow to be opposite the main casting flow on the horizontal melt surface 130 thereby causing the oxides formed during the casting process to remain in the bottom sidewall portion 402 of the thermally insulated insert 400 and divides the oxides into smaller pieces as the oxides flow toward the cooled tubular body 100 thereby having limited surface area for nucleation and growth of oxide folds.

A means to distribute the melt 140 is positioned generally adjacent to the thermally insulated insert 400 and is adapted for use under a spout 150. Any means for distributing the melt may be used with this invention, including but not limited to the aforementioned sock, COMBO® bag, MINI® bag, and bag-in-a-bag are suitable for use in this invention. Further, the means to distribute the melt 140 for the instant invention includes any device that can diffuse the kinetic energy of the melt as it leaves the spout 150 and distributes the melt in a directed fashion. In a preferred embodiment of the instant invention, the means to distribute the melt 140 directs the melt both in a lateral and a downward direction with respect to the cooled tubular body 100. In a more preferred embodiment, the means to distribute the melt 140 directs the melt substantially in a downward direction with respect to the cooled tubular body 100. Directing the melt in a downward direction results in a stronger recirculation zone than if the melt is directed laterally. The spout 150 is a tubular member that directs the melt from the melt container into the mold. The tubular member may be comprised of any material that does not melt at casting temperatures and is preferably made of a ceramic material.

A starting block 160 is fitted in the lower end of the central cavity 700 at the start of casting. The starting block 160, which may be comprised of aluminum, steel, ceramic, or any other material that does not melt at casting temperatures, prevents contact of the molten metal with liquid. Once the metal is formed into a solid shell, the starting block 160 is lowered from the central cavity 700 to allow for the solid shell to be removed.

Prior to casting, lubricant is injected, via a lubricant pump (not shown), through the outer wall of the cooled tubular body 100, flows through the lubricant feed line 180, into the reservoir 181, and out through channels 300 that are present on the top surface 101 of the cooled tubular body 100. The lubricant continues to flow between the top surface 101 of the cooled tubular body 100 and the annular ring 500, and between the cooled inner wall 103 of the cooled tubular body 100 and the lip 501 of the annular ring 500 toward an area of transition of the bottom sidewall portion 402 of the thermally insulated insert 400, the lip 501 of the annular ring 500, and the cooled inner wall 103 of the cooled tubular body 100. Lubricant is needed to prevent the molten metal from adhering to the cooled inner wall 103. In addition, liquid is injected through the liquid inlet 104 prior to casting via a liquid pump (not shown). From the liquid inlet channel 104, the liquid flows through the liquid reservoir 105, into the liquid outlet channel 106, and out onto the ingot surface. The liquid in the reservoir 105 serves to both cool the cooled tubular body 100 and cool the casting by spraying along the cooling ingot surfaces from channel 106.

During the casting process, molten metal is introduced to the cooled tubular body from the spout 150 by positioning the discharge end of the spout 150 in the means to distribute the melt 140. The means to distribute the melt 140 contains a hole on each side and two holes on its bottom allowing the molten metal to be discharged laterally and downwardly. The molten metal comes into contact with the starting block 160, which is fitted in the lower end of the central cavity 700 at the start of casting to prevent contact of the molten metal with liquid. The starting block 160 is lowered once the molten metal has solidified.

The molten metal continues to fill the central cavity 700 until it reaches the middle portion of the bottom sidewall 402, where it forms the horizontal melt surface layer 130. The beveled sidewall of the bottom portion 402 forms an angle θ 120 with the horizontal melt surface layer 130, thereby creating a whirlpool. The whirlpool creates a redistribution zone that causes direction of the casting flow to be opposite the main casting flow on the flat melt surface layer 130. The whirlpool flow entrains oxides formed during the casting process, and inhibits their flow away from the bottom sidewall portion 402 of the thermally insulated insert 400. In addition, the whirlpool decreases the size of the oxides by breaking them into smaller pieces as the oxides flow toward the cooled tubular body 100. Reducing the size of the oxides limits its surface area for nucleation and growth of oxide folds.

Solidification of the molten metal is initiated as soon as the molten metal first comes into contact with the cooled inner wall 103 of the cooled tubular body 100. Once the ingot has completely solidified, it is cut into sections of desired length and these slabs are then available for subsequent forming operations (rolling, etc.).

The sidewall of the bottom portion 402 of the thermally insulated insert 400 could have a surface that is v-shaped as in FIGS. 2 and 3. In addition, FIGS. 4*a*–4*d* depict alternative surfaces for the sidewall of the bottom portion 402 of the thermally insulated insert 400. The sidewall of the bottom portion 402 could have a surface that is U-shaped as in 4*a*, has a plurality of steps as in 4*c*, has a plurality of ridges as in 4*d*, or has an outward slope as in 4*b*. Each of these surfaces would have a different effect on the eddy that is created by the angle between the sidewall of the bottom portion 402 and the horizontal melt surface layer 130.

It will be readily appreciated by those skilled in the art that modifications may be made to the invention without departing from the concepts disclosed in the forgoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

What is claimed is:

1. A mold for casting of molten metal alloys comprising:

a cooled tubular body having a top surface having an orifice, a bottom surface having an orifice, and a cooled inner wall, defining a central cavity;

an annular ring attached to said top surface of said cooled tubular body, said annular ring having a lip adjacent to said cooled inner wall of said cooled tubular body; and a thermally insulated insert having a top portion and a bottom portion, said top portion being wider than said bottom portion, said bottom portion having a beveled sidewall overlapping said lip of said annular ring and said cooled inner wall of said cooled tubular body, said beveled sidewall of said bottom portion angled inwardly toward the center of the mold cavity of said mold, said bottom portion attached to said annular ring and said top surface of said cooled tubular body.

2. The mold of claim 1, wherein said cooled tubular body includes a cooling means.

3. The mold of claim 1, wherein said cooled tubular body includes a continuous lubricating means.

4. The mold of claim 1 wherein said cooled tubular body comprises al aluminum alloy, ferrous alloy, a copper alloy, or a non-metallic material.

5. The mold of claim 1 wherein said annular ring comprises a metal alloy.

6. The mold of claim 1 wherein said thermally insulating insert is comprised of a ceramic material.

7. The mold of claim 1 wherein said thermally insulating insert is comprised of a calcium silicate reinforced with graphite fiber.

8. The mold of claim 1 wherein said beveled sidewall of said bottom portion of said thermally insulated insert has a pre-selected shape selected from the group consisting of a v-shape, a u-shape, a plurality of steps, a plurality of ridges, and an outward slope.

9. A mold for casting of molten metal alloys comprising:

a cooled tubular body having a top surface having an orifice, a bottom surface having an orifice, and a cooled inner wall, defining a central cavity;

an annular ring attached to said top surface of said cooled tubular body, said annular ring having a lip adjacent to said cooled inner wall of said cooled tubular body;

a sealing means located between said annular ring and said top surface of said cooled tubular body;

a cooling means comprising liquid inlet channels, liquid reservoirs, and liquid outlet channels, said liquid inlet channels connected to the sides of said cooled tubular body, said liquid reservoirs and outlet channels within said cooled tubular body;

a lubricant means comprising lubricant feed lines, lubricant reservoirs, and lubricant channels, said lubricant feed lines and reservoirs located within said cooled tubular body, said lubricant channels located on said top surface of said cooled tubular body;

a thermally insulated insert having a top portion and a bottom portion, said top portion being wider than said bottom portion, said bottom portion having a beveled sidewall overlapping said lip of said annular ring and said cooled inner wall of said cooled tubular body, said beveled sidewall of said bottom portion angled inwardly toward the center of the mold cavity of said mold, said bottom portion attached to said annular ring and said top surface of said cooled tubular body.

10. A method of casting molten metal alloys with improved surface quality, comprising:

providing a direct chill casting mold having a thermally insulated insert and an annular ring over a cooled tubular body, said cooled tubular body having a top surface having an orifice, a bottom surface having an orifice, and a cooled inner wall, said cooled tubular body having a sealing means between said top surface of said cooled tubular body and said annular ring, said cooled tubular body containing a lubrication means comprising lubricant feed lines, lubricant reservoirs, lubricant channels, and a lubricant contained therein, said lubricant feed lines and reservoirs located within said cooled tubular body, said lubricant channels located on said top surface of said cooled tubular body, said thermally insulated insert having a top portion and a bottom portion whereby said bottom portion includes a beveled sidewall of said bottom portion angled toward the center of the mold cavity of said mold;

cooling said cooled inner wall surface of said cooled tubular body;

directing said lubricant to flow to said lubricant channels, across said top surface of said cooled tubular body, between said cooled inner wall and a lip of said annular ring and thereafter through a gap between said cooled inner wall and said molten metal to be cast, said annular ring and said sealing means providing continuous lubrication from said lubricant channels to said gap;

introducing said molten metal to be cast adjacent to said bottom sidewall portion of said thermally insulated insert;

continuing to pass said molten metal through said mold until said molten metal reaches said beveled sidewall of said bottom portion of said thermally insulated insert where said molten metal forms a horizontal melt surface layer, said beveled sidewall of said bottom portion forming an angle with said horizontal melt surface layer of said molten metal, said angle being below said horizontal melt surface layer and producing an eddy near said beveled sidewall during casting, said eddy creating a (1) recirculation zone that causes direction of the casting flow to be opposite the main casting flow on said horizontal melt surface thereby causing oxides formed during the casting process to remain in the beveled sidewall portion of said thermally insulated insert and (2) a break-up of said oxides into smaller pieces as said oxides flow toward said cooled tubular body thereby having limited surface area for nucleation and growth of oxide folds;

solidification of said molten metal as said molten metal comes into contact with said cooled inner wall of said cooled tubular body;

lowering of the starting block and removal of the solidified metal.

11. The method of claim 10 wherein said angle is from about 1 degree to about 89 degrees.

12. The method of claim 10 wherein said angle is from about 20 degrees to about 70 degrees.

13. The method of claim 10 wherein said angle is from about 40 degrees to about 50 degrees.

14. The method of claim 10 wherein said molten metal is introduced via a spout and a means to distribute the melt, said means to distribute the melt directing the melt both in a lateral and a downward direction with respect to said cooled tubular body.

15. A method for casting molten metal comprising pouring molten metal into a mold having a thermally insulated insert over a cooled tubular body, said thermally insulated insert having beveled sidewalls angled inwardly toward the mold cavity of said mold and forming an angle with the horizontal melt layer of said molten metal, said angle being below said horizontal melt surface layer and creating an eddy in the metal within the mold to reduce oxide formation on the surface of the solidified metal, and solidifying the metal.

16. The method of claim 15 wherein said angle creates said eddy.

17. The method of claim 15 wherein said angle is from about 1 degree to about 89 degrees.

18. The method of claim 15 wherein said angle is from about 20 degrees to about 70 degrees.

19. The method of claim 15 wherein said angle is from about 40 degrees to about 50 degrees.

20. The method of claim 15 wherein reducing said oxide formation on said surface of said solidified metal reduces surface imperfections that may create cracks in said solidified metal.

* * * * *